United States Patent [19]

Larson

[11] 4,437,039

[45] Mar. 13, 1984

[54] STARTING ARRANGEMENT FOR HIGH-INTENSITY-DISCHARGE SODIUM LAMP

[75] Inventor: Daniel A. Larson, Cedar Grove, N.J.

[73] Assignee: North American Philips Electric Corp., New York, N.Y.

[21] Appl. No.: 88,424

[22] Filed: Oct. 25, 1979

Related U.S. Application Data

[63] Continuation-in-part of Ser. No. 948,131, Oct. 3, 1978, Pat. No. 4,191,910.

[51] Int. Cl.[3] ..... H01J 7/44; H01J 17/34; H01J 19/78; H01J 29/96; H01K 1/62

[52] U.S. Cl. ..... 315/60; 313/331; 313/246; 313/633; 313/625; 313/311; 315/56; 315/73; 315/74

[58] Field of Search ..... 315/56, 70, 60, 73, 315/74; 313/331, 332, 246, 334, 624, 625, 634, 594, 602, 311, 596, 635, 633

[56] References Cited

U.S. PATENT DOCUMENTS

| | | | |
|---|---|---|---|
| 2,200,939 | 5/1940 | Trebbin et al. | 313/596 |
| 3,461,334 | 8/1969 | Knochel et al. | 313/602 |
| 3,469,729 | 9/1969 | Grekila et al. | 220/2.3 |
| 4,037,129 | 7/1977 | Zack et al. | 313/594 |
| 4,092,560 | 5/1978 | Puskas | 313/246 |
| 4,160,930 | 7/1979 | Driessen et al. | 313/331 |
| 4,191,910 | 3/1980 | Larson | 315/60 |
| 4,208,605 | 6/1980 | McVey et al. | 313/625 |
| 4,339,686 | 7/1982 | Potter | 313/635 |

FOREIGN PATENT DOCUMENTS

| | | | |
|---|---|---|---|
| 2316857 | 10/1974 | Fed. Rep. of Germany | 315/60 |

*Primary Examiner*—Saxfield Chatmon, Jr.

[57] ABSTRACT

High-intensity-discharge (HID) sodium lamp has a starting aid comprising a conducting ceramic which is hermetically sealed to and extends through an alumina arc tube at least at one end thereof to form an electrically conducting path. The conducting ceramic is fused to the alumina arc tube and is electrically conductive by virtue of having embedded therein a small percentage of finely divided refractory metal. At least during starting, the conducting ceramic is electrically connected through a resistor to the opposite lamp electrode and, as a result, on application of energizing potential, a glow discharge is established between an arc-tube-interior portion of the conducting ceramic and the adjacent electrode to ionize the atmosphere within the arc tube and facilitate lamp starting.

15 Claims, 9 Drawing Figures

STARTING ARRANGEMENT FOR HIGH-INTENSITY-DISCHARGE SODIUM LAMP

This application is a continuation-in-part of copending application Ser. No. 948,131, now U.S. Pat. No. 4,191,910 filed Oct. 3, 1978, by D. A. Larson, the present applicant, and owned by the present assignee.

BACKGROUND OF THE INVENTION

This invention relates to high-intensity-discharge (HID) sodium lamps and, more particularly, to an improved starting arrangement for such lamps.

HID sodium lamps are relatively difficult to start and normally require the application of a very high voltage pulse across the lamp electrodes. Other types of HID lamps incorporate a starting electrode sealed through an end of the arc tube and which is closely spaced to one of the main electrodes. In the case of HID sodium lamps, however, the space limitations normally preclude such a starting electrode, or at least make the incorporation of a starting electrode quite difficult.

A starting electrode for the HID sodium lamp is disclosed in Japanese Pat. No. 47-49382 dated Dec. 12, 1972. As shown in FIG. 2 of this patent, the starting aid comprises a metallic, annular-shaped member which is sealed on both sides to two tubular-shaped envelope members to form the arc tube body.

In German published patent application 2,316,857 dated Oct. 3, 1974 is disclosed a starting electrode for HID sodium lamps wherein a metallic coating (5*a* in the Figures) is formed on the face of a ceramic ring 5 which, in turn, is sealed to the main tubular ceramic body to form the arc tube.

U.S. Pat. No. 3,461,334, dated Aug. 12, 1969 to Knochel et al. discloses a starting electrode for an HID sodium lamp wherein an annular-shaped metallic member is sealed to two tubular-shaped ceramic members to form the composite arc tube with the sealed starting arrangement.

Japanese Preliminary Publication of Utility Model Patent Application 49-102573 dated Sept. 4, 1974 discloses a starting electrode which is sealed through the ceramic end cap portion of a ceramic arc tube. A similar disclosure is set forth in U.S. Pat. No. 4,052,635 dated Oct. 4, 1977.

Various sealing materials for sealing refractory metals to alumina are known and U.S. Pat. No. 3,469,729 dated Sept. 30, 1969 to Grekila et al. discloses a calcia-alumina-silica composition for sealing tantalum or niobium to alumina. In U.S. Pat. No. 3,480,823 dated Nov. 25, 1969 to Chen is disclosed a somewhat similar composition which incorporates from 2% to 5% by weight of niobium powder to improve the bonding strength of the seal.

The use of a thermal switch which is responsive to the heat generated by an operating lamp to remove a starting potential from a starting electrode for an HID metal-halide-type lamp is shown in U.S. Pat. No. 3,226,957 dated Dec. 28, 1965 to Green, and U.S. Pat. No. 3,746,941 dated July 17, 1973 to Olson et al. discloses an HID sodium lamp wherein a wire starting aid is coiled about the arc tube, and after the lamp is operating, bi-metal switches isolate the starting aid from other electrical elements of the lamp.

SUMMARY OF THE INVENTION

The basic lamp comprises a high-intensity-discharge sodium lamp comprising an arc tube formed as an elongated, hollow, alumina body member of predetermined dimensions and having alumina end-closure members hermetically sealed to the end portions of the hollow body member. The arc tube encloses a discharge-sustaining filling of sodium or sodium plus mercury plus inert ionizable starting gas. Electrodes are operatively positioned within the arc tube proximate the ends thereof and electrical lead-in means are sealed to and extend through the alumina end-closure members and connect to the electrodes to form a composite electrode lead-in structure. A light-transmitting protective envelope surrounds the arc tube and frame means is positioned within the outer envelope for supporting the arc tube in predetermined position therein. An electrical adapter means is affixed to the outer envelope for connection to a source of power and a pair of electrical connection means connect the adapter means to the electrical lead-in means, with one of the electrical connection means including the frame which serves to electrically connect one of the electrodes to the electrical adapter.

In accordance with the present invention, the arc tube has electrically conducting ceramic means hermetically sealed to and extending through the arc tube at least at one end thereof in order to form an electrically conducting path means through the arc tube. A portion of the conducting ceramic means is positioned interiorly of the arc tube and is electrically insulated from the proximate electrical lead-in means. The conducting ceramic means comprises refractory-oxide-based ceramic matrix which is non-reactive with respect to high-temperature sodium vapor and which possesses the predetermined thermal-physical-chemical properties required to form a high-temperature seal with alumina. The refractory-oxide-based conducting ceramic means has embedded therein a predetermined amount of finely divided refractory metal which is inert with respect to the discharge-sustaining filling to provide the ceramic means with a predetermined electrical conductivity. An electrically insulating barrier means is positioned intermediate the arc-tube-interior portion of the conducting ceramic and portions of the electrical lead-in conductor means which project interiorly of the arc tube and are proximate the conducting ceramic. This barrier is dimensioned to intercept any condensed discharge-sustaining filling and prevent same from forming a conducting path between the conducting ceramic and the proximate lead-in conductor. During starting of the lamp, the conducting ceramic means electrically connect, exteriorly of the arc tube, to the electrode which is positioned proximate the opposite end of the arc tube from the connected conducting ceramic. During lamp starting, the electrical resistance between the arc-tube-interior portion of the conducting ceramic and the connected opposite electrode permit the maintenance of a glow-type discharge within the arc tube which ionizes the atmosphere therein in order to facilitate lamp starting.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
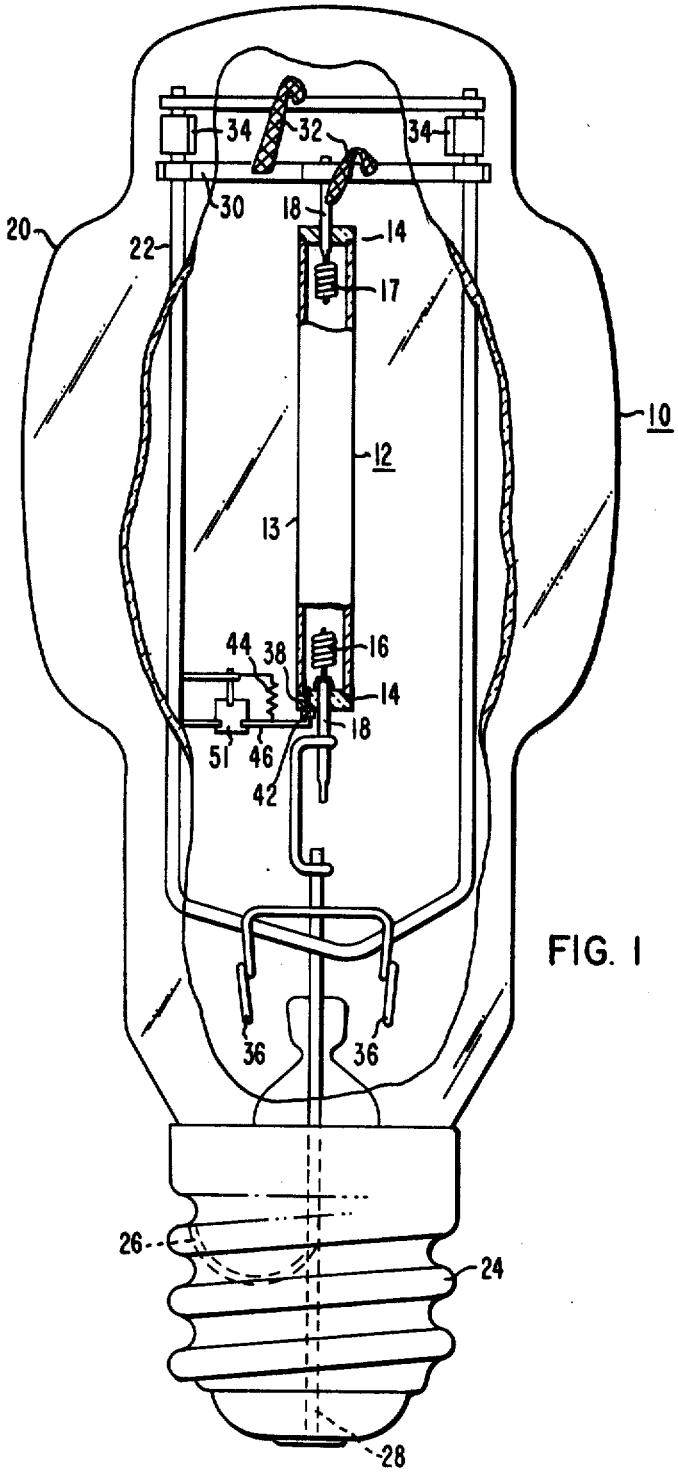
FIG. 1 is an elevation view, shown partly in section, of an HID sodium lamp which incorporates the present improved starting aid.

With specific reference to the form of the invention illustrated in the drawings, the lamp 10 as shown in FIG. 1 comprises an elongated alumina arc tube 12 of predetermined dimensions comprising an elongated, hollow, alumina body member 13 having alumina end-closure members 14 hermetically sealed to the end portions of the hollow body member 13 and enclosing a discharge-sustaining filling comprising sodium or sodium plus mercury and inert ionizable starting gas such as xenon at a pressure of 20 torr, for example. Electrodes 16 and 17 are operatively positioned within the arc tube 12 proximate the ends thereof and lead-in means 18 which comprise niobium tubes are sealed to and extend through the alumina end-closure members 14 and connect to the electrodes 16, 17 to form composite electrode-lead-in structures.

A light-transmitting protective outer envelope 20 surrounds the arc tube and a frame 22 is positioned within the outer envelope and supports the arc tube 12 in predetermined position within the outer envelope 20. Electrical adapter means, such as a suitable screw-type base 24, is affixed to the outer envelope for connection to a source of power and a pair of electrical connection means, 26, 28 serve to connect the base to the lead-ins 18. One of the electrical connectors 26 is connected to and includes the frame 22 for supplying power to one of the lamp electrodes 17.

To complete the general description, the upper support member 30 is movable on the lamp frame 22 to facilitate expansion and contraction of the arc tube 12 and connection to the arc tube electrode 17 is made through flexible conductors 32. The upper portion of the frame is supported and positioned within the dome of the outer envelope 20 by suitable leaf-spring supports 34. The outer envelope 20 normally encloses a hard vacuum which is obtained through use of suitable getter elements which are flashed from the getter supports 36.

Figure 2:
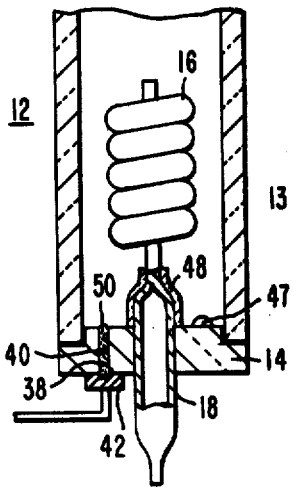
FIG. 2 is a fragmentary enlarged view, shown partly in section, of a portion of the end of an arc tube showing the details of the conducting ceramic starting aid and the electrical connections thereto.

In accordance with the present invention, and as shown in detail in the enlarged fragmentary view of FIG. 2, an electrically conducting ceramic means is hermetically sealed to and extends through the arc tube at least at one end thereof to form electrically conducting path means through the arc tube. In the embodiment as shown in FIG. 2, the electrically conducting path is formed by a plug-like member 38 which has predetermined dimensions and extends through the alumina end-closure member 14 of the arc tube. This plug-like conducting member comprises refractory-oxide-based ceramic matrix which is non-reactive with respect to high-temperature sodium vapor and which possesses the predetermined thermal-physical-chemical properties required to form a high-temperature seal with alumina. The refractory-oxide-based ceramic matrix is fused to the surrounding portions of the alumina end-closure member 14 and there is embedded in the ceramic matrix a predetermined amount of finely divided refractory metal 40 which is inert with respect to the arc tube discharge-sustaining filling, in order to provide the plug-like conducting member 38 with a predetermined electrical conductivity. As a specific example, the hollow alumina body member 13 of the arc tube is formed of polycrystalline or single crystal alumina and the end-closure members 14 are formed of polycrystalline alumina. The ceramic matrix portion of the conducting ceramic plug 38 is formed of 49.9% by weight calcia, 42.6% by weight alumina and 7.5% by weight silica in accordance with the aforementioned U.S. Pat. No. 3,469,729. Embedded within the ceramic matrix is approximately 4% by weight of niobium powder which has a state of division such that it will pass a number 325 mesh or seive. Electrical contact is made to the plug 38 by means of a small metallic plate 42 which can be formed of niobium or other suitable refractory metal and in the preferred form, electrical contact is made between the plug 38 and the small plate 42 by means of a small amount of additional conducting ceramic which bonds the plate 42 to the outer surface of the end-closure member 14. The plate 42 can also be provided with a layer of silicon on the inner surface thereof in order to increase the bond to the conducting ceramic and other ceramic and such an enhanced bond is taught in U.S. Pat. No. 4,103,200 dated July 5, 1978 to R. S. Bhalla. Referring again to FIG. 1, the small plate 42 is permanently connected via a suitable resistor 44 and connecting lead 46 to the frame 22 of the lamp.

When the lamp is not operating, the discharge-sustaining material will tend to condense at the coolest portions of the arc tube, and condensed discharge-sustaining material 47 is graphically represented in FIG. 2. Particularly at the bottom portions of the arc tube, this condensed material 47 can short out the normally non-conducting path between the plug 38 and the lead-in conductor 18 which is proximate thereto. In order to prevent this, there is placed between the conducting ceramic 38 and the proximate lead-in conductor 18 an electrically insulating barrier means which project interiorly of the arc tube, with the barrier means being dimensioned to intercept any condensed discharge-sustaining filling and prevent same from forming a conducting path between the conducting ceramic 38 and the proximate lead-in conductor 18. In the embodiment as shown in FIG. 2, this barrier means has the form of a layer 48 of sealing material formed over that portion of the niobium tube lead-in structure which projects inwardly within the arc tube.

During starting of the lamp, the conducting ceramic means 38 is thus electrically connected, exteriorly of the arc tube, to that electrode 17 which is positioned proximate the opposite end of the arc tube 12 from the conducting ceramic 38. In this manner, the full starting potential is applied between the inner surface portion 50 of the conducting ceramic 38 and the proximate lamp electrode 16. While the resistance of the conducting ceramic 38 could be controlled by varying the amount of refractory metal embedded therein, it is preferred to limit the current which the conducting ceramic can pass by incorporating the resistor 44 in series therewith so that during lamp starting, the total electrical resistance between the interior surface 50 of the plug-like conducting ceramic 38 and the connected opposite electrode 17 permits the maintenance of a glow-type discharge within the arc tube. This ionizes the atmosphere within the arc tube and facilitates starting of the lamp.

Figure 3:
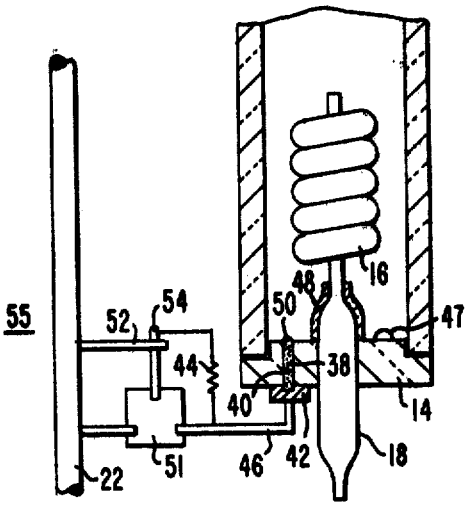
FIG. 3 is a fragmentary enlarged view, partly in section, showing a thermal switch arrangement for removing the starting aid from the circuit once the lamp is normally operating.

In the enlarged fragmentary view of FIG. 3 are shown the details for the circuit connections to the starting aid conducting ceramic member 38. An insulating supporting member 51 is affixed to the proximate frame portion 22 and carries the switch contact members 52, 54 of a thermally actuated switch. The switch is responsive to the heat generated by the normal operation of the arc tube to cause the bimetal element 52 to move from contact with its cooperative contact and thus remove the starting aid from the circuit once the lamp is operating. For some embodiments it is not necessary to remove the starting aid from the operating lamp circuit since the resistor 44, which typically has a value of 20,000 ohms, prevents any appreciable current flow through the conducting ceramic member 38.

To complete the description of the lamp as shown in FIG. 1, the lamp is designed to operate with a wattage of 70 watts and the arc tube 12 has a spacing between the electrodes of 25 mm, an inner diameter of 5.3 mm, and a wall thickness of 0.5 mm. The alumina end-closure members have a thickness of 2.5 mm. The discharge-sustaining filling of the arc tube is sodium in amount of 30 mg or an amalgam of sodium and mercury in amount of 6.3 mg sodium and 23.7 mg mercury. The inert ionizable starting gas is xenon at a pressure of 20 torr and other starting gases at varying pressures can be substituted for xenon, a typical example being the Penning mixture.

In fabricating the arc tube embodiment as shown in FIG. 2, a small hole having a diameter of 0.2 mm can be bored in the end-closure member 14 and the unfired ceramic matrix material plus the powdered niobium inserted into the formed hole as a frit. The end-closure member 14 is then fired at a temperature of 1400° C. for three minutes in a vacuum or inert atmosphere. This provides the conducting ceramic path 38 having the niobium powder 40 embedded therein and thereafter, the lead-in conductor 18 can be assembled therewith and the assembly affixed to the arc tube in accordance with conventional practices.

As an alternative construction, while the preferred material for the refractory-oxide-based ceramic matrix of which the conducting ceramic 36 is formed is a mixture of calcia-alumina-silica, any other refractory-oxide-based ceramic matrix which is non-reactive with respect to high-temperature sodium vapor and which possesses the predetermined thermal-physical chemical properties required to form a high-temperature seal with alumina may be substituted therefor. As an example, yttria-based materials which are known in the art as sealing materials for alumina arc tubes can be substituted for the preferred example as given. Another suitable sealing material is disclosed in U.S. Pat. No. 3,281,309 dated Oct. 25, 1966 to Ross. As a specific example, the ceramic matrix of the conducting material 38 comprises from about 44% to 55% by weight calcia, from about 40% to 50% by weight alumina, and from about 0.5 to 10% by weight silica. Also, any finely divided refractory metal which is inert with respect to the discharge-sustaining fillings can be substituted for the preferred niobium, examples being tantalum or titanium or mixtures thereof. The percentage of niobium added is not particularly critical and a 4% by weight addition has been found to be very suitable. The more niobium which is added, the lower the resistivity and vice versa.

Figure 5:
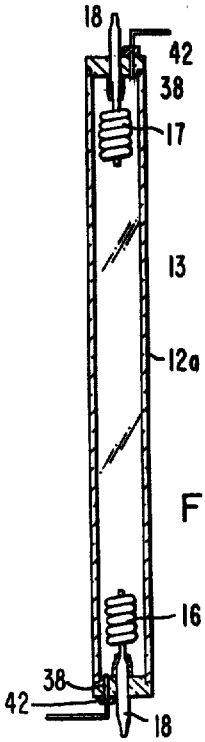
FIG. 5 is an enlarged view of an arc tube provided with the starting aid embodiment generally as shown in FIG. 4.
Figure 4:
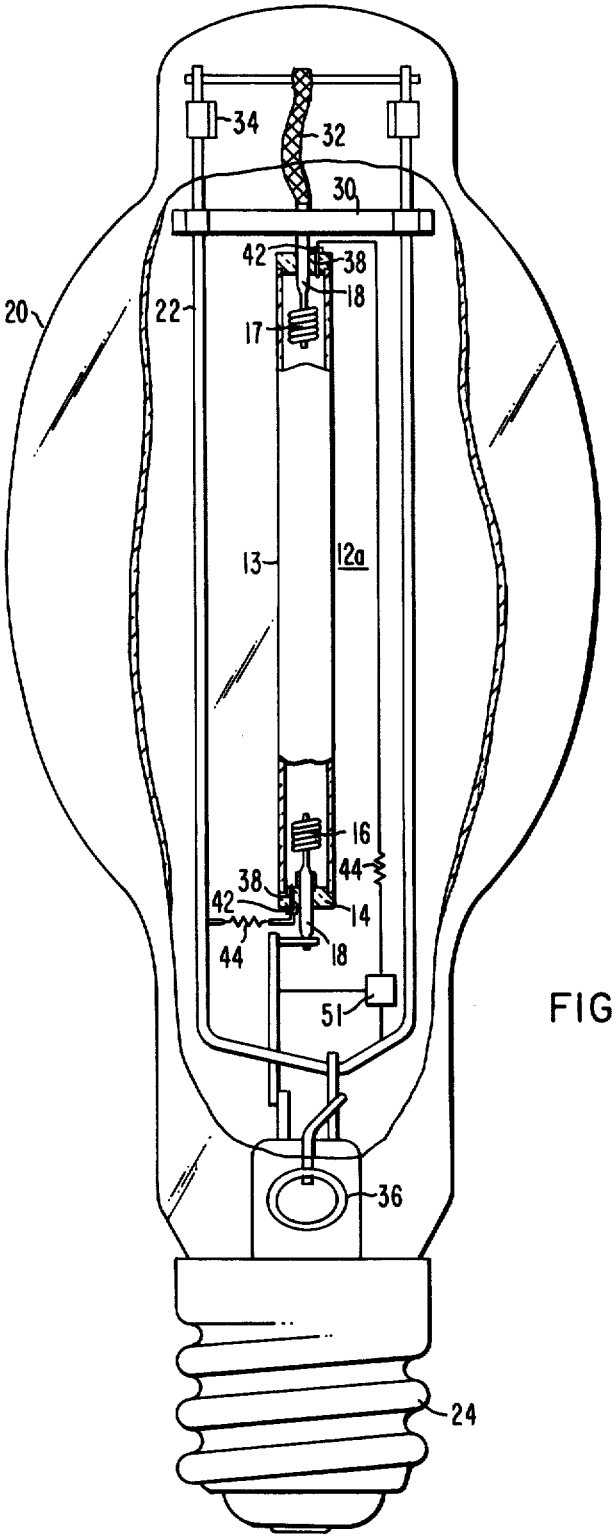
FIG. 4 is an elevational view of the lamp generally similar to the lamp shown in FIG. 1, but wherein starting aids are provided at both ends of the arc tube and are permanently connected to the power supply for the lamp.

An alternative lamp structure is shown in FIG. 4 wherein like numerals refer to like parts as described for the previous lamp embodiment. This includes the arc tube **12*a*, arc tube body 13, alumina end-closure members 14, electrodes 16, 17, lead-in conductors 18, outer envelope 20, arc tube supporting frame 22, screw-type base 24, upper support member 30, flexible conductors 32, leaf-spring supports 34, getter supports 36, conducting ceramic starting aid 38, niobium metal contact 42, starting aid resistor 44 and insulating support member 51. Such a lamp is designed for 400 watts wherein the arc tube 12*a* has a spacing between the electrodes of 80 mm, an inner diameter of 8 mm, and a wall thickness of 0.75 mm. The discharge-sustaining filling for the arc tube comprises 30 mg sodium or a sodium-mercury amalgam comprising 6.3 mg sodium and 23.7 mg mercury, with an inert ionizable starting gas of xenon at a pressure of 20 torr. In this embodiment, starting aids 38 are provided at both ends of the arc tube with each starting aid connected through a resistor 44 to the electrode which is positioned at the opposite end of the arc tube. The starting aids are designed to remain electrically connected at all times, even after the lamp is operating, although they could be isolated by means of thermal switches as described hereinbefore. Thus in the embodiment as shown in FIG. 4, starting is facilitated by glow discharges which are established at both ends of the lamp. The arc tube as used in the lamp shown in FIG. 4 is shown in FIG. 5 wherein both ends of the arc tube are provided with the conducting ceramic paths 38 through the alumina end-closure members 14**.

Figure 6:
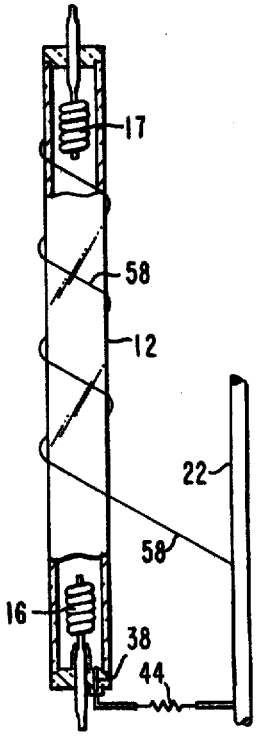
FIG. 6 is an enlarged elevational view, shown partly in section, of an arc tube which is provided with still another starting aid embodiment.

FIG. 6 illustrates yet another embodiment wherein a starting aid 38 is provided at one end of the arc tube and a wire helix 58 is wrapped about the arc tube and directly connected to the frame 22 of the lamp. Once the glow discharge is established between the ceramic conducting member 38 and the proximate electrode 16, the helical wire 58 which surrounds the arc tube aids in propagating the discharge to the other operating electrode. This helical starting aid can remain connected in circuit at all times or it can be disconnected by means of a thermal switch once the lamp is operating.

The arc tubes having the modified starting aids are described hereinbefore can be mounted in various different types of envelopes with varying type connector means. For example, the arc tube supporting frame need not constitute one of the electrical connection means for connecting the base to the arc tube. Alternatively, the lamp could be double-ended if desired.

Figure 7:
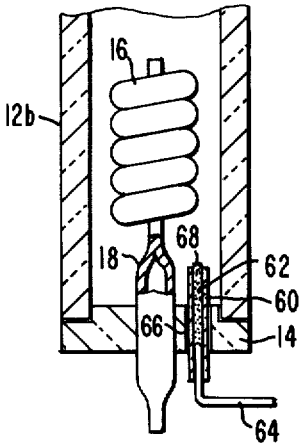
FIG. 7 is a fragmentary enlarged view, partly in section, of the end portion of an arc tube showing details of still another embodiment which incorporates a modified starting aid.

In FIG. 7 is illustrated a modified starting aid embodiment wherein a small diameter alumina tube 60 is hermetically sealed through at least one of the alumina end-closure members 14 of the arc tube. The alumina tubular member 16 is spaced from the adjacent lead-in conductor 18 and longitudinally extends a short predetermined distance into the arc tube toward that electrode 16 which is supported by the adjacent lead-in conductor. By limiting the inwardly extending dimension of the tube 60, there is no tendency for the tube to contact the electrode body 16. The conducting ceramic frit as described hereinbefore is fused within the alumina tube 60 in order to provide the electrically conducting path through the arc tube and the alumina tubular member 60 has affixed thereto an electrical connection adapter 64 which extends exteriorly of the arc tube **12*b* to facilitate electrical connection. In this embodiment, the alumina tube 60 is sealed through the end-closure 14 with a fused non-conducting frit 66 so that the tube body serves as the barrier means to prevent condensed discharge sustaining amalgam from shorting out the path between the conducting frit 62 and the adjacent lead-in conductor 18. During lamp starting, a glow discharge is established between the exposed end 68 of the conducting frit on the adjacent portion of the lamp electrode 16**.

Figure 8:
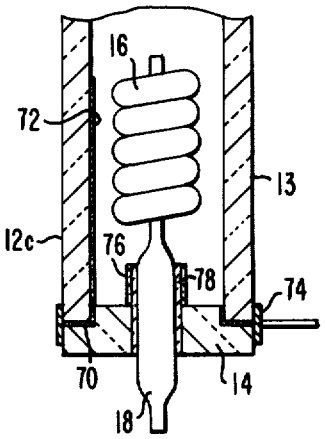
FIG. 8 is an enlarged fragmentary view, shown partly in section, of the end portion of an arc tube showing still another embodiment of a starting aid.

In FIG. 8 is shown still another arc tube embodiment **12*c* wherein at least one of the alumina end-closure members 14 is sealed to the longitudinal arc tube body 13 by means of the fused conducting ceramic frit 70, as described hereinbefore. To facilitate the starting, an additional conducting ceramic stripe is formed as a longitudinally disposed coating 72 on the interior wall of the arc tube and this extends the conducting path to a location which is proximate the inwardly extending end of the electrode 16 which is proximate thereto. To facilitate electrical connection, an annular niobium sleeve 74 fits about the end of the arc tube and is fritted thereto. In this embodiment the barrier means which prevents shorting out between the lead-in member 18 and the conducting frit 70, 72 is provided by an alumina sleeve 76 which is affixed about the inwardly projecting portion of the lead-in conductor 18 by means of fused non-conducting ceramic frit 78 which is also used to affix the lead-in conductor 18 to the end cap 14**.

Figure 9:
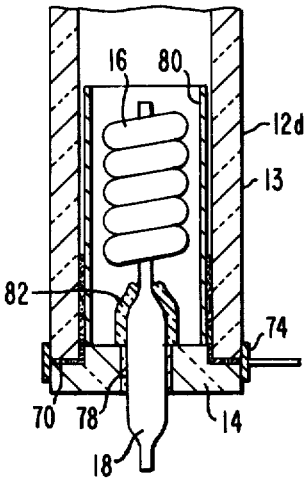
FIG. 9 is a fragmentary enlarged view, partly in section, of the end portion of an arc tube showing yet another embodiment of a starting aid which also serves as a heat reservoir.

In FIG. 9 is shown still another arc tube embodiment **12*d* wherein the fused conducting frit 70 is used to seal the end closure 14 to the longitudinal tube wall portion 13. An additional annular refractory metal sleeve 80 which can be fabricated of tantalum, niobium or tungsten, for example, which is inert with respect to the discharge-sustaining filling, is interiorly fitted into at least one end of the arc tube to electrically contact the conducting ceramic frit 70 and to longitudinally extend within the arc tube to a position proximate the adjacent electrode 16. As in the previous embodiment, the electrical connection is facilitated by an additional exterior niobium sleeve 74 which is fritted to the conducting ceramic 70. The additional interior sleeve 80 thus provides the dual function of facilitating starting and also provides a heat reservoir thereby increasing the energy flow to the end portion of the lamp. In this embodiment 12*d* the niobium lead-in member 18 is sealed through the end-closure 14 by means of non-conducting ceramic frit 78 and an additional layer of non-conducting ceramic frit 82 is provided over those portions of the lead-in conductor 18 which project interiorly within the arc tube in order to provide the barrier means to prevent condensed discharge-sustaining material from shorting out the path between the inner metallic sleeve 80 and the proximate lead-in conductor 18**.

What is claimed is:

1. In combination with a high-intensity-discharge sodium lamp comprising an arc tube formed as an elongated hollow alumina body member of predetermined dimensions having alumina end-closure members hermetically sealed to the end portions of the hollow body member and enclosing a discharge-sustaining filling comprising sodium and inert ionizable starting gas, electrodes operatively positioned within said arc tube proximate the ends thereof, electrical lead-in means sealed to and extending through said alumina end-closure members and connecting to said electrodes to form composite electrode-lead-in structures, a light-transmitting protective outer envelope surrounding said arc tube, frame means positioned within said outer envelope for supporting said arc tube in predetermined position within said outer envelope, electrical adaptor means affixed to said outer envelope for connection to a source of power, a pair of electrical connection means connecting said electrical adaptor means to said electrical lead-in means, and one of said electrical connection means including said frame means to electrically connect one of said electrodes to said electrical adaptor means, the improvement which comprises:

(a) electrically conducting ceramic means hermetically sealed to and extending through said arc tube at least at one end thereof to form electrically conducting path means through said arc tube, a portion of said conducting ceramic means positioned interiorly of said arc tube and electrically insulated from the proximate electrical lead-in means, said conducting ceramic means comprising refractory-oxide-based ceramic matrix which is non-reactive with respect to high-temperature sodium vapor and which possesses the predetermined thermal-physical-chemical properties required to form a high-temperature seal, with alumina, and said refractory-oxide-based conducting ceramic means having embedded therein a predetermined amount of finely divided refractory metal which is inert with respect to said discharge-sustaining filling to provide said conducting ceramic means with a predetermined electrical conductivity;

(b) electrically insulating barrier means positioned intermediate said arc-tube-interior portion of said conducting ceramic means and portions of said electrical lead-in conductor means which project interiorly of said arc tube and are proximate said conducting ceramic means, and said barrier means being dimensioned to intercept any condensed discharge-sustaining filling and prevent same from forming a conducting path between said conducting ceramic means and the proximate lead-in conductor means; and (c) during starting of said lamp said conducting ceramic means electrically connect, exteriorly of said arc tube, to the said electrode which is positioned proximate the opposite end of said arc tube from the connected conducting ceramic means, and during starting of said lamp the total electrical resistance between said arc-tube-interior portion of said conducting ceramic means and the connected opposite electrode permitting the maintenance of a glow-type discharge within said arc tube between said arc tube interior portion of said conducting ceramic means and the said composite electrode-lead-in structure which is proximate thereto to ionize the atmosphere within said arc tube.

2. The combination as specified in claim 1, wherein said electrically-conductive ceramic means is connected to said frame means through a starting resistor of predetermined value.

3. The combination as specified in claim 2, wherein said electrically conducting ceramic means and said starting resistor are permanently connected to said frame means.

4. The combination as specified in claim 2, wherein after said lamp is normally operating, said electrically conducting ceramic means is electrically isolated from said frame means by a switch means which opens in response to normal lamp operation.

5. The combination as specified in any of claims 2, 3 or 4, wherein a starting assistance conductor directly electrically connects to said frame means and extends longitudinally along the exterior of said arc tube.

6. The combination as specified in claim 1, wherein said electrically conducting ceramic means comprises calcia-alumina-silica matrix having embedded therein finally divided niobium powder.

7. The combination as specified in claim 6, wherein said niobium powder constitutes about 4% by weight of said electrically conducting ceramic means, and said matrix comprises about 44% to 55% by weight calcia, from about 40% to 50% by weight alumina and from about .05% to 10% by weight silica.

8. In combination with a high-intensity-discharge sodium lamp comprising an arc tube formed as an elongated hollow alumina body member of predetermined dimensions having alumina end-closure members hermetically sealed to the end portions of the hollow body member and enclosing a discharge-sustaining filling comprising sodium and inert ionizable starting gas, electrodes operatively positioned within said arc tube proximate the ends thereof, electrical lead-in means sealed to and extending through said alumina end-closure members and connecting to said electrodes to form a composite electrode-lead-in structure, a light-transmitting protective outer envelope surrounding said arc tube, means positioned within said outer envelope for supporting said arc tube in predetermined position within said outer envelope, electrical adapter means affixed to said outer envelope for connection to a source of power, and a pair of electrical connection means connecting said electrical adaptor means to said electrical lead-in means, the improvement which comprises:

(a) electrically conducting ceramic means hermetically sealed to and extending through said arc tube at least at one end thereof to form electrically conducting path means through said arc tube, a portion of said conducting means positioned interiorly of said arc tube and electrically insulated from the proximate electrical lead-in means, said conducting ceramic means comprising refractory-oxide-based ceramic matrix which is non-reactive with respect to high-temperature sodium vapor and which possesses the predetermined thermal-physical chemical properties required to form a high-temperature seal with alumina, and said refractory-oxide-based conducting ceramic means having embedded therein a predetermined amount of finely divided refractory metal which is inert with respect to said discharge-sustaining filling to provide said conducting ceramic means with a predetermined electrical conductivity;

(b) electrically insulating barrier means positioned intermediate said arc-tube-interior portion of said conducting ceramic means and portions of said electrical lead-in conductor means which project interiorly of said arc tube and are proximate said conducting ceramic means, and said barrier means being dimensioned to intercept any condensed discharge-sustaining means and prevent same from forming a conducting path between said conducting ceramic means and the proximate lead-in conductor means; and (c) during starting of said lamp said conducting ceramic means electrically connect, exteriorly of said arc tube, to the said electrode which is positioned proximate the opposite end of said arc tube from the connected conducting ceramic means, and during starting of said lamp the total electrical resistance between said arc-tube-interior portion of said conducting ceramic means and the connected opposite electrode permitting the maintenance of a glow-type discharge within said arc tube between said arc-tube-interior portion of said conducting ceramic means and the said composite electrode-lead-in structure which is proximate thereto to ionize the atmosphere within said arc tube.

9. A combination arc tube for a high-intensity-discharge sodium lamp, said arc tube comprising an elongated hollow alumina body member of predetermined dimensions having alumina end-closure members hermetically sealed to the end portions of said hollow body member and enclosing a discharge-sustaining filling comprising sodium and inert ionizable starting gas, electrodes operatively positioned within said arc tube proximate the ends thereof, electrical lead-in means sealed to and extending through said alumina end-closure members and connecting to said electrodes, electrically conducting ceramic means hermetically sealed to and extending through said arc tube at least at one end thereof to form electrically conducting path means through said arc tube, a portion of said conducting ceramic means positioned interiorly of said arc tube and electrically insulated from the proximate electrical lead-in means, electrically insulating barrier means positioned intermediate said arc-tube-interior portion of said conducting ceramic means and portions of said electrical lead-in means which project interiorly of said arc tube and are proximate said conducting ceramic means, and said barrier means being dimensioned to intercept any condensed discharge-sustaining means and prevent same from forming a conducting path between said conducting ceramic means and the proximate lead-in conductor means.

10. The combination as specified in claims 1, 8 or 9, wherein said alumina end-closure members are sealed to the ends of said elongated hollow alumina body member with said conducting ceramic means to form the electrically conducting path means through said arc tube, and said barrier means is positioned about those portions of said electrical lead-in means which project interiorly of said arc tube and are proximate said conducting ceramic means.

11. The combination as specified in claims 1, 8 or 9, wherein said alumina end-closure members are sealed to the ends of said elongated hollow alumina body member by said conducting ceramic means to form the electrically conducting path means through said arc tube, said barrier means is positioned about those portions of said electrical lead-in means which project interiorly of said arc tube and are proximate said conducting ceramic means, and additional conducting ceramic means is formed as a longitudinal conducting stripe on the interior wall of said arc tube and extending from said conducting path means through said arc tube proximate the said electrode which is proximate thereto.

12. The combination as specified in claims 1, 8 or 9, wherein said alumina end-closure members are sealed to the ends of said elongated hollow alumina body member by said conducting ceramic means to form the electrically conducting path means through said arc tube, said barrier means is positioned about those portions of said electrical lead-in means which project interiorly of said arc tube and are proximate said conducting ceramic means, and refractory metal sleeve means which is inert with respect to said discharge-sustaining filling is interiorly fitted into at least one end of said arc tube to electrically contact said electrically conducting path means and to longitudinally extend to a position proximate the adjacent electrode, thereby to provide a combination heat reservoir and conducting starting assistance means.

13. The combination as specified in claims 1, 8 or 9, wherein said alumina end-closure members are sealed to the ends of said elongated hollow alumina body member by said conducting ceramic means to form the electrically conducting path means through said arc tube, said barrier means is positioned about those portions of said electrical lead-in means which project interiorly of said arc tube and are proximate said conducting ceramic means, and refractory metal sleeve means is fitted about at least one end portion of said arc tube to electrically contact said conducting ceramic means to facilitate electrical connection thereto.

14. The combination as specified in claims 1, 8 or 9, wherein said electrically conducting path is formed as a plug-like member means formed of said conducting ceramic means, said plug-like member means having predetermined dimensions and extending through at least one of said alumina end-closure members of said arc tube and sealed thereto, and said barrier means is positioned about those portions of said electrical lead-in means which project interiorly of said arc tube and are proximate said plug-like member means.

15. The combination as specified in claims 1, 8 or 9, wherein alumina tubular member means is hermetically sealed through at least one of said alumina end-closure members of said arc tube, said alumina tubular member means being spaced from the adjacent lead-in conductor means and longitudinally extending a short predetermined distance into said arc tube toward that said electrode which connects to the said adjacent lead-in conductor means, said conducting ceramic means is fused within said alumina tubular member means to provide the electrically conducting path through said arc tube, and said alumina tubular member means having affixed thereto electrical connection adaptor means which extends exteriorly of said arc tube and electrically connects to said conducting ceramic means.

* * * * *